United States Patent [19]

Smerker

[11] Patent Number: 4,977,914

[45] Date of Patent: Dec. 18, 1990

[54] SLIP RESISTENT APPARATUS FOR CANES, CRUTCHES AND WALKERS

[76] Inventor: Charles W. Smerker, 3833 Vigilante Dr., Great Falls, Mont. 59405

[21] Appl. No.: 382,217

[22] Filed: Jul. 20, 1989

[51] Int. Cl.[5] ..... A45B 9/04

[52] U.S. Cl. ..... 135/81; 135/70; 135/80

[58] Field of Search ..... 135/70, 78, 80, 81

[56] References Cited

U.S. PATENT DOCUMENTS

| | | | |
|---|---|---|---|
| 47,265 | 4/1865 | Allamby et al. | 135/81 |
| 51,677 | 12/1865 | Allamby et al. | 135/81 |
| 909,129 | 1/1909 | Ricks | 135/70 |
| 1,164,608 | 12/1915 | Care | 135/81 |
| 1,298,721 | 4/1919 | Hughes | 135/81 |
| 2,596,733 | 5/1952 | Sibner | 135/81 |
| 2,682,175 | 6/1954 | Eyrich | 135/70 |
| 3,448,749 | 6/1969 | Stark | 135/81 |
| 4,364,405 | 12/1982 | Norwood et al. | 135/81 |
| 4,411,284 | 10/1983 | Opitz | 135/81 |
| 4,434,808 | 1/1984 | Burak | 135/80 |

FOREIGN PATENT DOCUMENTS

| | | | |
|---|---|---|---|
| 67127 | 3/1893 | Fed. Rep. of Germany | 135/81 |
| 334915 | 3/1921 | Fed. Rep. of Germany | 135/81 |
| 2124824 | 11/1972 | Fed. Rep. of Germany | 135/80 |

*Primary Examiner*—David A. Scherbel
*Assistant Examiner*—Caroline D. Dennison
*Attorney, Agent, or Firm*—Richard C. Conover

[57] ABSTRACT

A slip resistent apparatus for walking aids such as canes, crutches and walkers is disclosed. The apparatus provides a spring biased, lever actuated, selectively operable, ground engaging probe slidingly displaced within the vertical structure of the walking aid. The probe is a pointed elongate rod. A hand operated lever with attached actuating arm is affixed to the walking aid and rests against the upper portion of the rod. Actuation of the lever transmits a compressive force to the spring biased probe extending the pointed tip to make engagement with the ground, thus providing a slip resistant walking aid. The sliding rod is adjustable in length to accommodate different heights of walking aids and is adapted to fit the different types of walking aids including canes, crutches and walkers.

5 Claims, 4 Drawing Sheets

SLIP RESISTENT APPARATUS FOR CANES, CRUTCHES AND WALKERS

BACKGROUND OF THE INVENTION

1. Field of the Invention.

This invention relates to a slip resistent apparatus for walking aids such as canes, crutches and walkers, and in particular to such a slip resistent apparatus of the type having a ground engaging probe selectively extending from the lower extremity of the walking aid.

2. Discussion of the Technical Problems.

Walking aids such as canes, crutches and walkers are types of hand-held medical support devices which assist and support injured and infirm people. Elderly, injured and hanicapped persons need support while walking and the walking aids usually employed provide the needed assistance indoors and during periods of warm dry weather. Unfortunately, with the coming of wet, icy and snowy conditions, the walking aid itself becomes quite dangerous. The user relies heavily on the walking aid for support since firm footing is no longer available yet the cane, crutch or walker in such conditions has also lost its ability to provide a firm support. The condition of the pavement or ground is so crucial for the safe use of such walking aids that the many people who use those devices will not venture out if the conditions are not perfect. While an icy walkway is a minor hazard or inconvenience for most people, it becomes a major barrier to a convalescing person equipped with a slip prone crutch or cane. Such people are in need of a walking aid that provides a selectable slip resistance at the point of contact between the walking aid and the ground.

Prior art devices have been invented to improve the ground engaging capability of the walking aids. In fact, U.S. Pat. No. 47,265 issued Apr. 18, 1865 to Allamby, et al discloses a crutch having a moveable spike in the foot of a crutch. The spike can be pushed out when desired and held in position by means of a catch moving on a curved slot. A refinement of the same device is shown in U.S. Pat. No. 51,677 issued Dec. 26, 1865 also to Allamby et al.

Other devices which provide a spike extending from the foot of a walking aid and provide a catch are shown in U.S. Pat. No. 1,298,721 issued Apr. 1, 1919 to Hughes, and U.S. Pat. No. 4,411,284 issued Oct. 25, 1983 to Optiz.

While prior art devices disclose spikes and extendable gripping feet, they do not provide an easy way for the user to actuate and deactuate the gripping spike. In such prior art devices, it is necessary for the user to reach down to the foot of the walking aid and engage the spike. Such actuation is inconvenient and could also be dangerous on slippery ground.

The user of a walking aid should be able to actuate the ground engaging spike by simply moving a hand lever located near the users hand. The instant invention is directed to such a need. The instant invention thus provides a spring biased, lever actuated, selectively operable, ground engaging probe slidingly displaced within the vertical structure of the walking aid. The probe is a pointed elongate rod. A hand operated lever with attached actuating arm is affixed to the walking aid and rests against the upper portion of the rod. Actuation of the lever transmits a compressive force to the spring biased probe extending the pointed tip to make engagement with the ground, thus providing a slip resistent walking aid. The sliding rod is adjustable in length to accommodate different heights of walking aids and is adapted to fit different types of walking aids including canes, crutches and walkers.

The instant invention is directed to all of these needs as well as to others as explained in the following summary.

SUMMARY OF THE INVENTION

It is a feature of the invention to provide a slip resistent apparatus for walking aids such as canes, crutches and walkers.

It is another feature of the instant invention to provide a lever acuated ground engaging spike within a walking aid.

It is yet another feature of the instant invention to provide an easily adapted universal slip resistant apparatus for attachment to a walking aid.

These and other features and objects are attained according to the instant invention by providing a spring biased, lever actuated, selectively operable, ground engaging probe slidingly displaced within the vertical structure of a walking aid. The probe is a pointed elongate rod. A hand operated lever with attached actuating arm is affixed to the walking aid and rests against the upper portion of the rod. Actuation of the lever transmits a compressive force to the spring biased probe extending the pointed tip to make engagement with the ground, thus providing a slip resistent walking aid. The sliding rod is adjustable in length to accommodate different heights of walking aids and is adapted to fit the different types of walking aids including canes, crutches and walkers.

BRIEF DESCRIPTION OF THE DRAWINGS

The advantages of this invention will become apparent upon consideration of the following detailed disclosure of the invention, especially when taken in conjunction with the accompanying drawings, wherein.

DESCRIPTION OF THE PREFERRED EMBODIMENT

Figure 1:
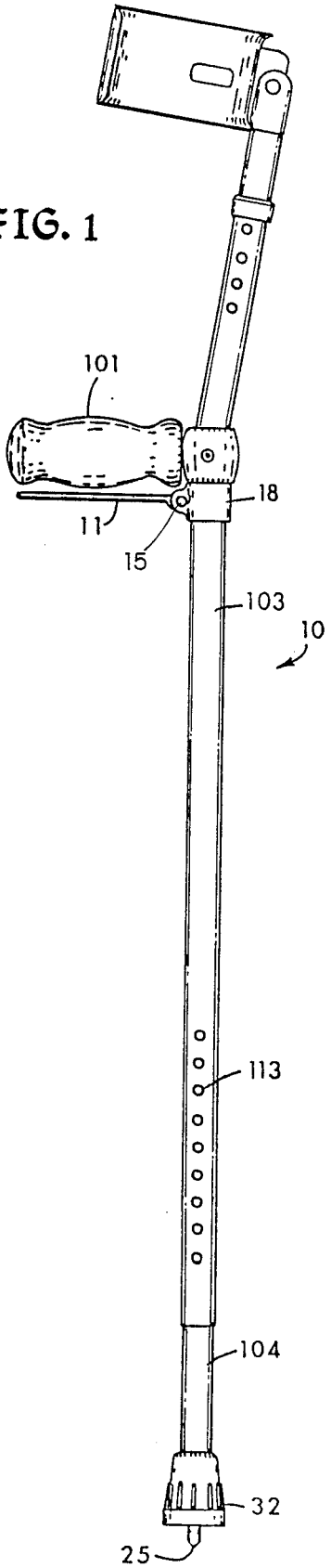
FIG. 1, is a side elevational view of a cane with the slip resistant probe extended in accordance with the present invention.

With reference to FIG. 1, it can be seen that a cane 10 is shown fitted with a spike 25 which extends from the lower portion of cane 10 to make contact with the ground. When the spike 25 is retracted, cane foot cap 32 without spike 25 makes contact with the ground and the cane 10 is used in the ordinary manner. Adjustment holes 113 are depicted for adjustment of the cane 10 in the manner known in the art in which lower tubular extension 104 telescopically moves with respect to cane barrel 103. Handle 101 is provided with actuating lever 11 located below handle 101 where lever 11 can be gripped with the same hand used on handle 101. Lever 11 is pivotally attached to bracket 18 which is secured by clamping it onto cane leg 103.

Figure 2:
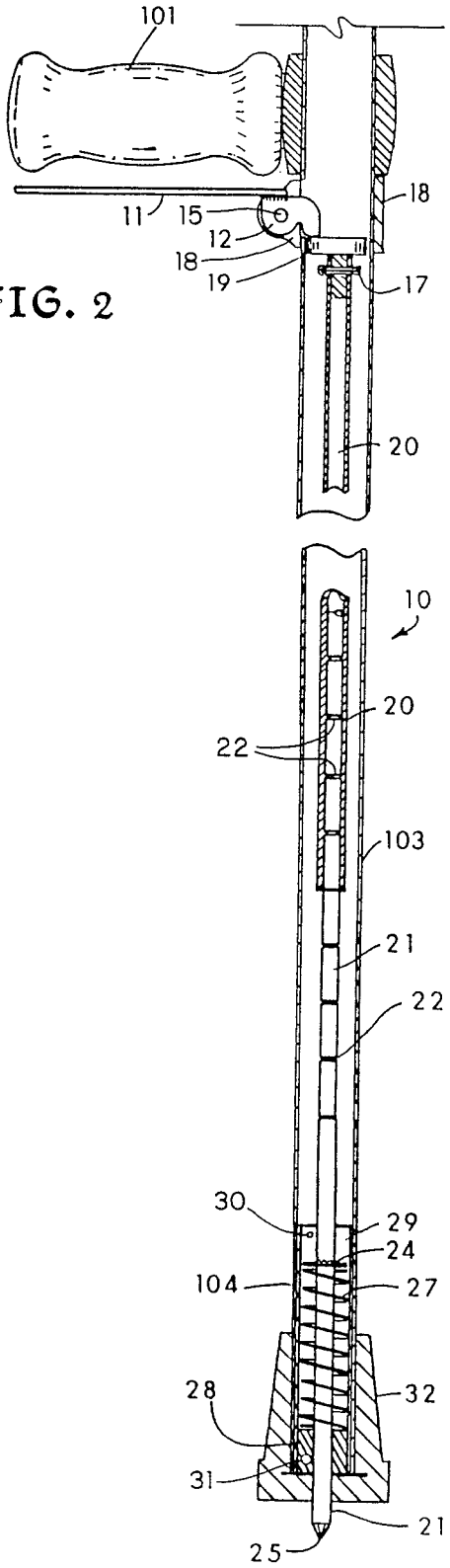
FIG. 2 is a partial cutaway side elevational view of a cane with the slip resistant probe extended in accordance with the present invention.

With reference to FIG. 2, it can be seen that lever 11 is fitted with actuating spur 12 extending into the hollow interior of cane barrel 103 where it rests against cap 19 which in turn is attached to elongate tube 20 which is adjustably attached to elongate rod 21 terminating in spike 25. The upward and clockwise rotation (as shown in FIGS. 1 and 2) of lever 11 thus exerts a force on cap 19 by way of spur 12. The compressive force thus exerted urges spike tip 25 through the hole in foot tip 32 to make engagement with the ground.

In order to keep the spike tip 25 in a retracted position while lever 11 is not being actuated, spring 27 is provided. Spring 27 is a coil spring having its hollow longitudinal axis about rod 21. Spring stop 24 is provided for spring 27 to act upon rod 21 to urge rod 21 upwardly. Spring stop 24 is a flat plate attached to rod 21.

Bushing 28 is provided to insure that rod 21 travels in a positive up and down movement. Bushing 28 is fitted within cane barrel 104 by being encased in sleeve 29 which is pinned to barrel 104 in a manner well known in the art.

Figure 3:
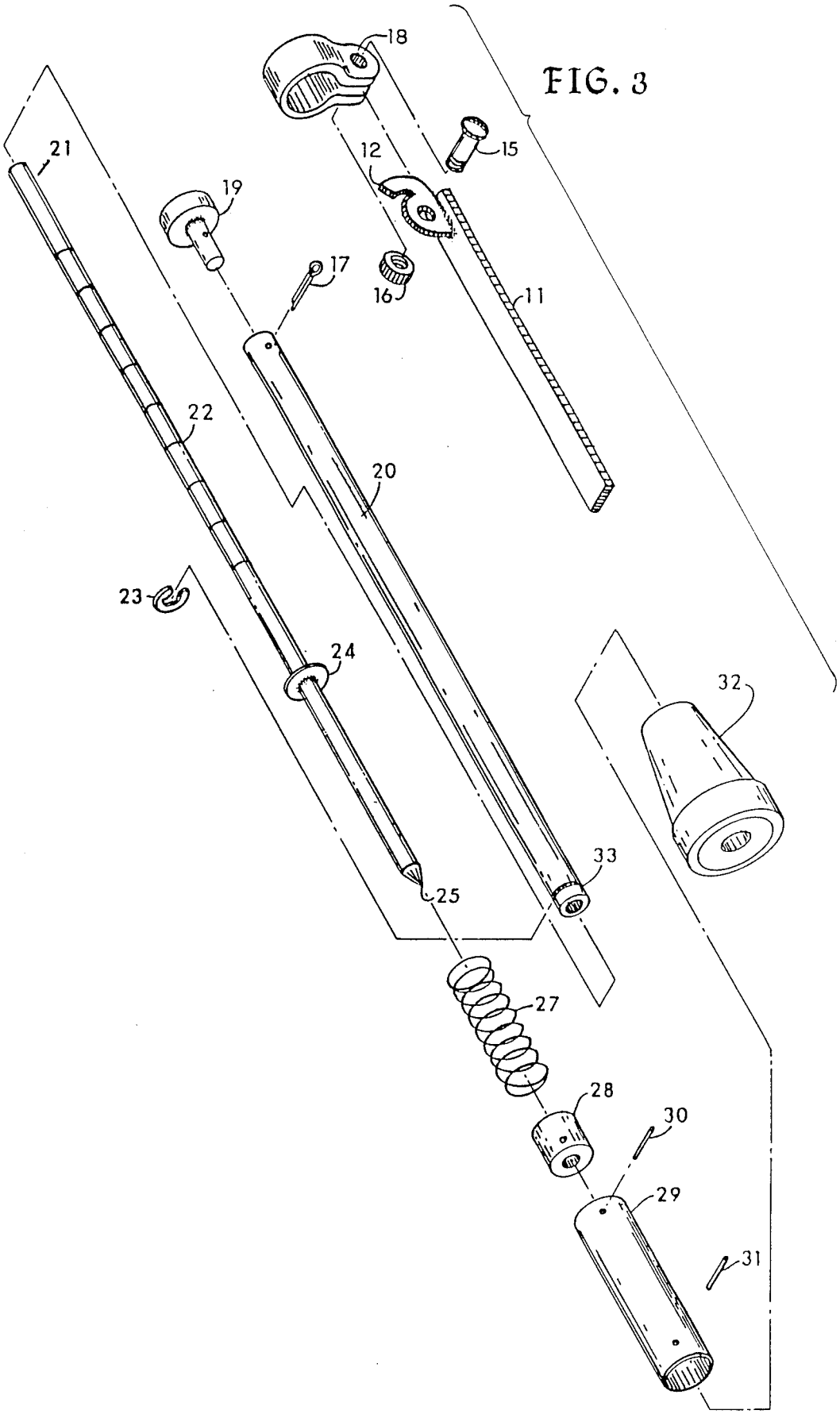
FIG. 3 is an exploded perspective view of the working parts of the actuating mechanism in accordance with the present invention.

Adjustment is provided by having rod 21 and elongate tube 20 telescopically slide with respect to each other and rod 21 is provided with slot indentations 22 into which "C" clip 23 (as shown in FIG. 3) is inserted at the proper indentation 22 for the correct length of rod 21 and tube 20 combination.

Now with reference to FIG. 3 where it can be seen that elongate rod 21, spring 27 and bushing 28 are shown in exploded alignment. Elongate tube 20 and cap 19 are depicted in proper relationship to each other, and key 17 is provided to fit cap 19 to tube 20. It should be noted that slot 33 in the bottom end of tube 20 is provide so that clip 23 can be placed in slot 33 for adjustment of rod 21 and tube 20 combination rather than placing clip 23 at the end of the tube 20 as shown in FIG. 2. Sleeve 29 with pins 30 and 31 are shown. Sleeve 29 is used to attach bushing 28 to the lower leg of the walking aid as previously described.

Continuing with reference to FIG. 3, it should be noted that lever arm 11 with attached spur 12 and pivot pin 15 with nut 16 pivotally attach to bracket 18. Bracket 18 fits about barrel 103 to attach lever arm 11 to the walking aid.

Foot tip 32 is provided with an aperture through which tip 25 may extend. Tip 32 is a rubber tip found on many walking aids such as canes, crutches and walkers, except that tip 32 is provided with an aperture so that it can be used with the apparatus herein described.

Figure 4:
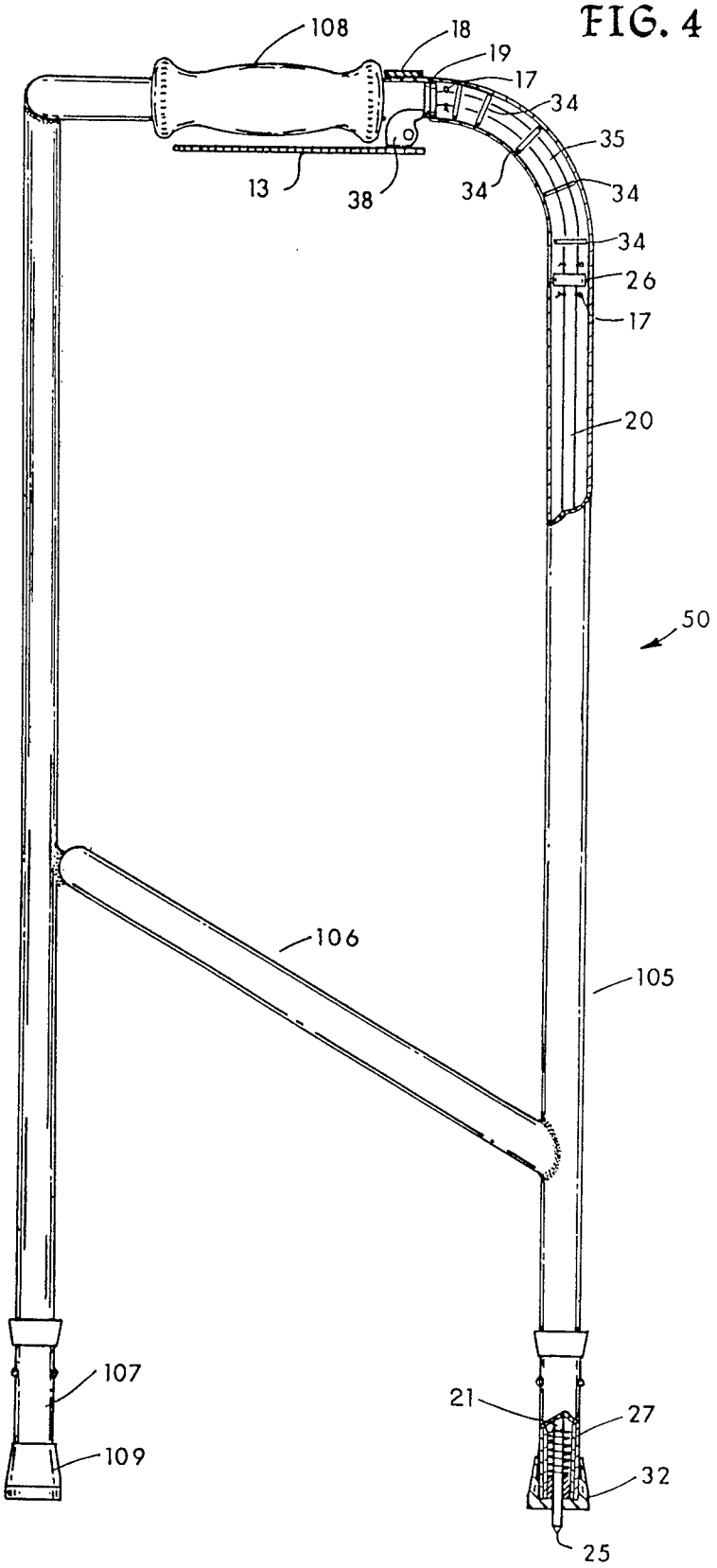
FIG. 4 is a partial cutaway side elevational view of a walker with the slip resistant probe extended in accordance with the present invention.

Connecter 26 as shown in FIG. 4 is provided for use with flexible shaft 35 and used with curved walking aids such as walkers. Connector 26 provides a connection between tube 20 and flexible shaft 35.

Lever arm 13 is shown in FIG. 4 with spur 28 for use with walkers in which the spur 38 exerts a compressive force horizontally upon raising lever 13.

Figure 5:
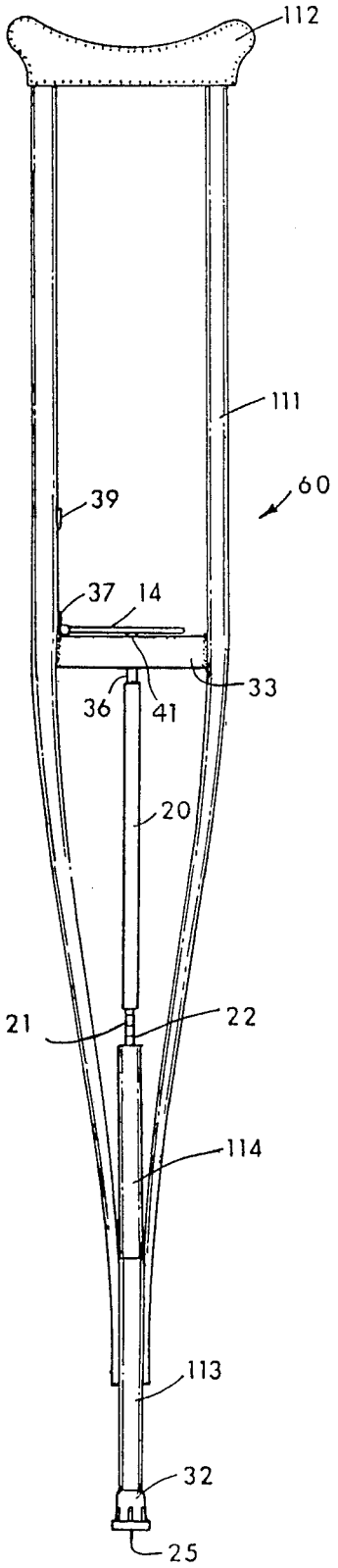
FIG. 5 is a side elevational view of a crutch with the slip resistant probe extended in accordance with the present invention.
Figure 6:
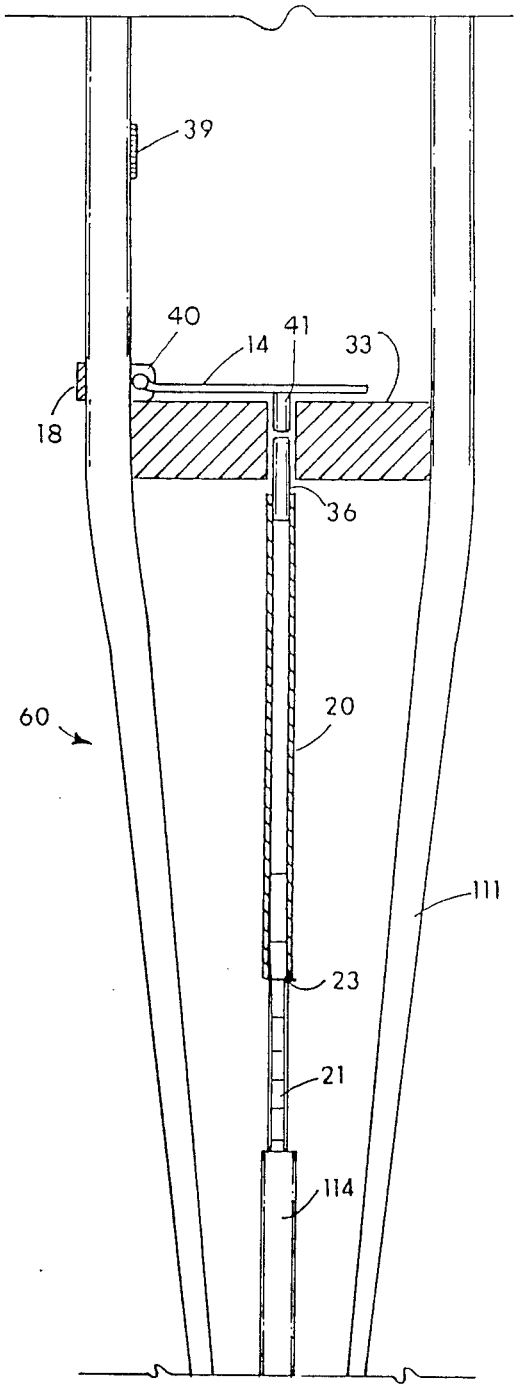
FIG. 6 is a partial cutaway side elevational view of a crutch with the slip resistant probe extended in accordance with the present invention.

Lever arm 14 is shown in FIGS. 3 and 6 with spur 41 for use with crutches in which the spur 41 exerts a compressive force vertically upon lowering lever 14. Pivot ring 40 is pivotally attached to bracket 18 as shown in FIGS. 5 and 6.

Now with reference to FIG. 4, it can be seen that the apparatus of the instant invention is fitted to a walker. The installation is similar to the adaptation discussed with respect to the cane, except that lever 13 is used instead of lever 11 and flexible shaft 35 is attached to the top of tube 20 by connector 26. Flexible shaft is guided through curved walker leg 105 by washers 34 so that when lever 13 is raised, spur 38 presses against cap 19 which exerts a compressive force on shaft 35 which in turn pushes on tube 20 and rod 21, compressing spring 27 and extending tip spike 25 out of foot tip 32.

It should be noted that the application as depicted in FIG. 4 includes a duplicate apparatus in the opposite walker leg corresponding to leg 105 so that the user can extend the two spikes in the rear legs of the walker 50.

Now with reference to FIG. 5 where a crutch 60 is depicted. Crutch 60 is provided with the similar apparatus as previously discussed with respect to walker 50 and cane 10 except that lever 14 is used and insert 36 is used on the top of tube 20 instead of cap 19. In use, lever 14 is urged downwardly which exerts a compressive force on tube 20 by way of insert 36 and spur 41 to move rod 21 downwardly and extend spike tip 25 as shown in FIG. 5. When lever arm 14 is not needed, it can be stowed by pivoting it up to touch magnet 39 to hold it in place, or it can be rotated about bracket 37 to slip out of the way.

Although specific applications, materials, components, connections, sequences of events, and methods have been stated in the above description of the preferred embodiment of the invention, other suitable materials, other applications, components and process steps as listed herein may be used with satisfactory results and varying degrees of quality. In addition, it will be understood that various other changes in details, materials, steps, arrangements of parts and uses which have been herein described and illustrated in order to explain the nature of the invention will occur to and may be made by those skilled in the art, upon a reading of this disclosure, and such changes are intended to be included within the principles and scope of this invention as hereinafter claimed.

I claim:

1. A slip resistant apparatus for walking aids of the type having a hollow tubular leg with an upper end and a lower end, the apparatus comprising:

a user handle located adjacent the upper end of the hollow tubular leg;

an elongate tube having an upper end and a lower end and positioned within the hollow tubular leg, the elongate tube further having a transverse slot extending through a wall of the tube and positioned adjacent the lower end of the elongate tube;

an elongate rigid rod having an upper end and a lower end with the upper end slidably received inside the elongate tube, the elongate rigid rod further having a plurality of indentations positioned along the longitudinal extent of the rod;

a spike tip integrally formed at the lower end of the elongate rigid rod;

a lever member pivotally attached intermediate its ends to the tubular leg adjacent the upper end of the tubular leg and having a first end positioned adjacent the handle and a second end operably abutting the upper end of said elongate tube, whereby when a user pivots the first end of the lever member toward the handle, the second end of the lever member pushes the elongate tube in a downward direction;

a spring biasing means connected between said hollow tubular leg and said elongate rigid rod for biasing said rod toward a normal rest position within the tubular leg;

a lower tubular extension telescopically received at the lower end of said tubular leg;

means for locking the tubular extension at a selected position within the tubular leg;

a foot tip removably mounted on a lower end of said tubular extension, said foot tip having an aperture sized and shaped to receive the elongate rigid rod;

means for selectively attaching the elongate rigid rod to the elongate tube at a position where the spike tip of the elongate rigid rod extends through the aperture of the foot tip when the first end of the lever is pivoted toward the handle and is retracted to the normal rest position within the tubular leg when the first end of the lever is released.

2. The slip resistant apparatus for walking aids as described in claim 1 wherein the elongate rigid rod further includes a series of indentations along the longitudinal extent of the rod and where the means for selectively attaching the elongate rigid rod to the elongate tube includes a resilient "C" clip frictionally positioned in surrounding relation on the elongate tube with a leg of the "C" clip extending through the slot in the elongate tube to cooperatively engage an indentation on the elongate rigid rod.

3. The slip resistant apparatus is walking aids as described in claim 1 where said apparatus is adapted to be attached to a cane.

4. The slip resistant apparatus for walking aids as described in claim 1 where said apparatus is adapted to be attached to a crutch.

5. The slip resistant apparatus for walking aids as described in claim 1 where said apparatus is adapted to be attached to a walker having a curved upper end.

* * * * *